US005164640A

United States Patent [19]

Son et al.

[11] Patent Number: 5,164,640

[45] Date of Patent: Nov. 17, 1992

[54] ELECTRON GUN FOR CATHODE RAY TUBE

[75] Inventors: Wan-jae Son, Cheonan; Sang-jin Park, Kyeongsangnam, both of Rep. of Korea

[73] Assignee: Samsung Electron Devices Co., Ltd., Kyunggi, Rep. of Korea

[21] Appl. No.: 809,573

[22] Filed: Dec. 18, 1991

[30] Foreign Application Priority Data

Dec. 29, 1990 [KR] Rep. of Korea ..... 90-21731

[51] Int. Cl.[5] ..... H01J 29/58

[52] U.S. Cl. ..... 315/382; 315/15; 313/414; 313/449

[58] Field of Search ..... 315/382, 382.1, 15; 313/414, 449

[56] References Cited

U.S. PATENT DOCUMENTS 4,701,677 10/1987 Ashizaki et al. ..... 315/382
4,886,999 12/1989 Yamane et al. ..... 315/382
4,967,120 10/1990 Katsuma et al. ..... 315/382
5,036,258 7/1991 Chen et al. ..... 315/382

*Primary Examiner*—Theodore M. Blum
*Attorney, Agent, or Firm*—Leydig, Voit & Mayer

[57] ABSTRACT

In an electron gun for cathode ray tubes in which the second of three focusing electrodes is divided into first, second, and third auxiliary electrodes, applying a first dynamic voltage synchronous with vertical and horizontal deflection signals to the first and third auxiliary electrodes, a second dynamic voltage synchronous with the deflection signals to the second auxiliary electrode, and a static focusing voltage higher than the maximum of the first and second dynamic voltages to the first and third focusing electrodes. The electron gun uses two dynamic focusing voltages in a low voltage driving method for low dynamic focusing voltages, thereby greatly reducing the possibility of an arc discharge between electrodes and compensating for astigmatism of the electron beam due to the non-uniform magnetic field of the deflection yoke. A sharp picture is achieved by improving the focusing of the electron beam.

6 Claims, 3 Drawing Sheets

ELECTRON GUN FOR CATHODE RAY TUBE

BACKGROUND OF THE INVENTION

The present invention relates to an electron gun for cathode ray tubes, and, more particularly to an electron gun which enhances the resolution of cathode ray tubes by correcting astigmatism and focus characteristic variations due to the nonuniform magnetic field of a deflection yoke so that spots where the electron beam collides with a phosphor screen are uniformly formed throughout the screen.

As cathode ray tubes become large and flatter, the deflection angle of the electron beam emitted from an electron gun becomes larger. A larger deflection angle causes greater astigmatism due to a nonuniform magnetic field produced by a deflection yoke, and a larger halo due to differences in the focusing distance at the screen's perimeter with respect to its center. These effects gradually deteriorate the resolution of a cathode ray tube.

In order to solve these problems, a dynamic focusing method is provided for varying the focus voltage in synchronization with a synchronous deflection signal applied to the deflection yoke, which can be divided into two driving methods: a low voltage method and a high voltage.

FIGS. 1A and 1B illustrate an electron gun G using the low-voltage dynamic focusing method. The sequential composition of electron gun G is a cathode K, a control electrode G1 and a screen electrode G2 which together form a front triode, and a first focusing electrode G3, a second focusing electrode G4', and a third focusing electrode G5 which focus and accelerate the electron beams, plus an anode electrode G6. The second focusing electrode G4' is divided into a first auxiliary electrode G4*a*', a second auxiliary electrode G4*b*', and a third auxiliary electrode G4*c*'. In the first and third electrodes G4*a*' and G4*c*' are formed circular electron beam passing holes, and in second electrode G4*b*' are formed three horizontally elongated, rectangular electron beam passing holes Hv. A static screen voltage Ve is applied to screen electrode G2, first electrode G4*a*', and third electrode G4*c*'. A focusing voltage Vf which is higher than static screen voltage Ve is supplied to the first and third focusing electrodes G3 and G5. Static screen voltage Ve (lower than the static focusing voltage Vf) is supplied to the first and third auxiliary electrodes G4*a*' and G4*c*' of the second focusing electrode G4'. Parabolic dynamic focusing voltage Vd is applied to the second auxiliary electrode G4*b*', synchronized with vertical and horizontal synchronous signals of the deflection yoke, and takes the static screen voltage Ve as its base voltage.

According to the conventional low-voltage dynamic focusing electron gun G, when electron beams are not deflected toward the periphery of the screen of a cathode ray tube, that is, when they are projected towards the phosphor screen's center, the lowest dynamic focusing voltage Vd (Vd=Ve) is applied to second electrode G4*b*' of second focusing electrode G4'. Electron beams thus passing through second focusing electrode G4', maintain their cross section and form circular electron beam spots on the center of the screen.

When electron beams emitted from cathode K are deflected by the deflection yoke toward the periphery of the screen, dynamic focusing voltage Vd, varied according to horizontal and vertical synchronous signals and higher than the static focusing voltage Ve(Vd>Ve), is applied to second electrode G4*b*. Thus, an intensive diverging lens is formed vertically by the horizontally elongated, rectangular electron beam passing holes Hv in the second focusing electrode G4' between the first and third focusing electrodes G3 and G5. The electron beams passing through the horizontally elongated electron beam passing holes have a vertically elongated cross section. When the electron beams are distorted by the deflection yoke's nonuniform magnetic field and land on the periphery of the screen, circular electron beam spots are formed.

Using dynamic focusing voltage Vd applied to second electrode Gb, the low-voltage dynamic focusing electron gun G compensates for astigmatism of beam spots which land on the screen when electron beams are deflected to the periphery of the screen. However, its compensating effect is too small to realize a sharp picture throughout the screen.

SUMMARY OF THE INVENTION

Therefore, it is an object of the present invention to provide an electron gun for cathode ray tubes which varies a focusing voltage synchronized with the deflection signal of a deflection yoke so as to vary the horizontal and vertical intensity of an auxiliary lens system and compensate for the distortion and focusing distance of electron beams landing on the screen, and thereby having no halo throughout the screen.

To achieve the object, there is provided in an electron gun for cathode ray tubes comprising a cathode, a control electrode and a screen electrode which form a first triode, at least first, second, and third focusing electrodes which form the main lens system, and an anode electrode, wherein the second focusing electrode includes first, second, and third auxiliary electrodes, a method including applying a first dynamic voltage synchronous with vertical and horizontal deflection signals to the first and third auxiliary electrodes, a second dynamic voltage synchronous with the deflection signal to the second auxiliary electrode, and a static focusing voltage higher than the maximum first and second dynamic voltages to the first and third focusing electrodes.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1A:
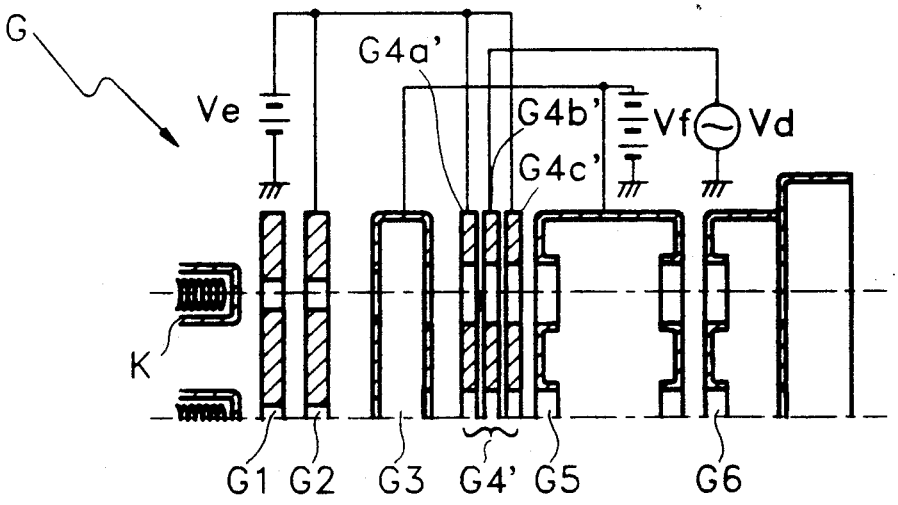
FIG. 1A (PRIOR ART)
FIG. 1A is a partial elevational cross section of a conventional electron gun for cathode ray tubes.
Figure 1B:
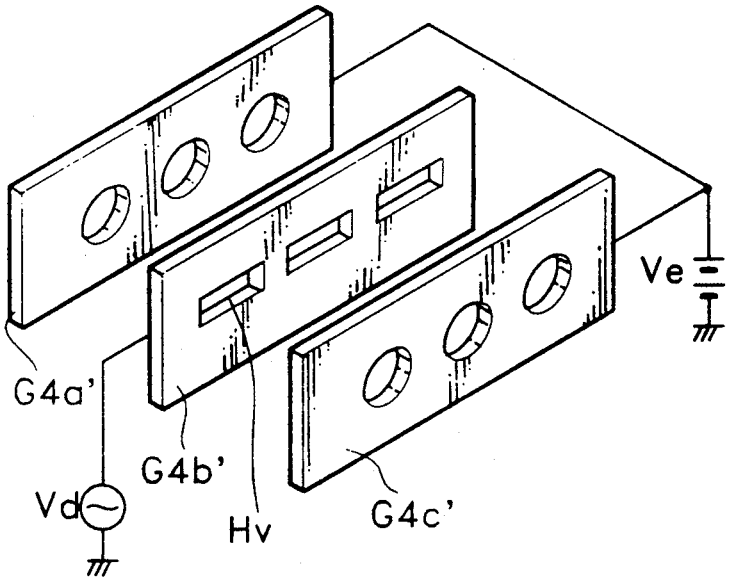
FIG. 1B (PRIOR ART)
FIG. 1B is a perspective view of the second focusing electrode of FIG. 1A.
Figure 2A:
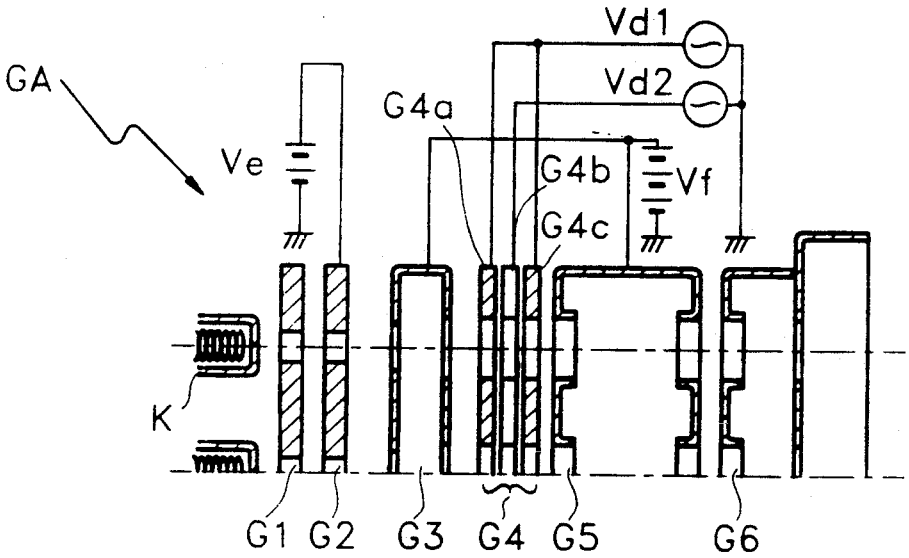
FIG. 2A is a partial elevational cross section illustrating the voltages applied to an electron gun for cathode ray tubes according to the present invention.
Figure 2B:
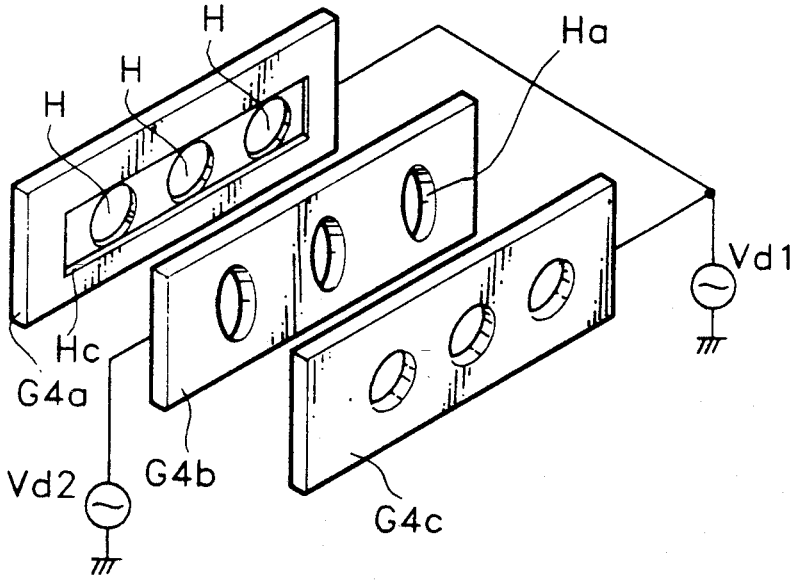
FIG. 2B is a perspective view of an embodiment of the second focusing electrode of FIG. 2A.

Referring to FIGS. 2A and 2B, the sequential composition of electron gun GA of the present invention is a cathode K, a control electrode G1 and a screen electrode G2 which form a first triode, a first focusing electrode G3, a second focusing electrode G4, and a third focusing electrode G5 which form a main lens system for focusing and accelerating electron beams, and an anode electrode G6. The second focusing electrode G4 is divided into a first auxiliary electrode G4*a*, a second auxiliary electrode G4*b*, and a third auxiliary electrode G4*c*. Circular electron beam passing holes are formed in the first and third auxiliary electrodes G4*a* and G4*c*. Vertically elongated, i.e., elliptical, electron beam passing holes Ha are formed in the second auxiliary electrode G4*b*. Horizontally elongated common electron beam passing hole Hc encompassing electron beam passing holes H is formed on the electron beam emitting side of the first auxiliary electrode G4*a* opposing the second auxiliary electrode G4*b*.

Figure 3:
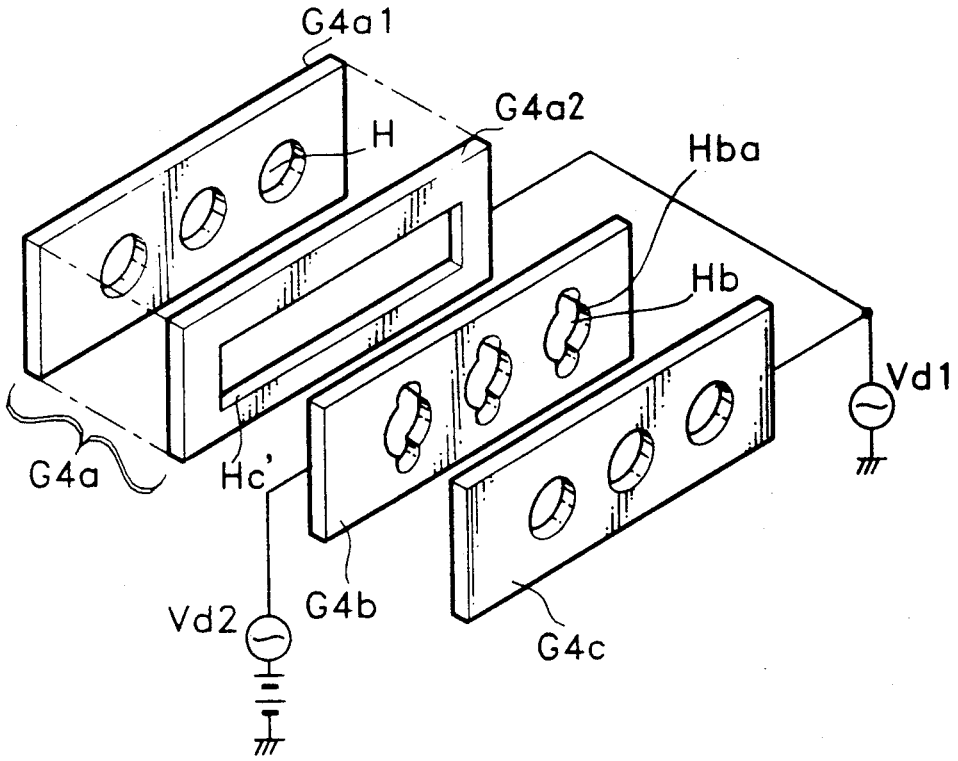
FIG. 3 is a perspective view of another embodiment of the second focusing electrode of FIG. 2A.

The horizontally elongated common electron beam passing hole Hc may be formed by compression-molding the first auxiliary electrode as shown in FIG. 2B, or may be formed of two separate components as shown in FIG. 3. In other words, the first auxiliary electrode G4*a* may be formed with an electrode component G4*a*1 having R, G, and B electron beam passing holes H and electrode component G4*a*2 having a horizontally elongated common electron beam passing hole Hc'.

In the electron gun, a static screen voltage Ve is applied to the screen electrode G2, and static focusing voltage Vf is applied to the first and third focusing electrodes G3 and G5. Positive first dynamic focusing voltage Vd1 is applied to the first and third auxiliary electrodes G4*a* and G4*c* of the second focusing electrode G4, and negative second dynamic focusing voltage Vd2 is applied to the second auxiliary electrode G4*b*. The base voltage Vs of the first dynamic focusing voltage Vd1 is the same as the maximum of the second focusing voltage Vd2. The screen voltage Ve is lower than the base voltage Vs which is lower than the focusing voltage Vf ($Ve<Vs<Vf$).

Figure 4:
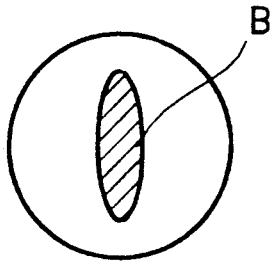
FIG. 4 is a cross section of an electron beam passing through a main lens of an electron gun for cathode ray tubes according to the present invention.

In contrast to applying voltage Vd1 to first and second auxiliary electrodes G4*a* and G4*b* of second focusing electrode G4, a low potential dynamic focusing voltage may be applied. Also, a dynamic focusing voltage higher than the first and second auxiliary electrodes may be applied to the third electrode G4*c*. Reference letter B of FIG. 4 represents a cross-section of the electron beam.

According to these voltage applying methods, a pre-focusing lens is formed by the potential difference between screen electrode G2 and first focusing electrode G3, a composite unipotential lens (to be described later) is formed by second focusing electrode G4 between first and third focusing electrodes G3 and G5, and a main lens is formed between third focusing electrode G5 and anode electrode G6. However, when an electron beam emitted from cathode K is not deflected by the deflection yoke, that is, when the electron beam is projected onto the center of the screen, no lens is formed between the auxiliary electrodes, since base voltage Vs of first dynamic focusing voltage Vd1 is applied to first and third auxiliary electrodes G4*a* and G4*c*, and the maximum of second dynamic auxiliary voltage Vd2 is applied to the second auxiliary electrode G4*b* of second focusing electrode G4, respectively. No lens is formed due to the lack of a potential difference ($Vd1=Vs=Vd2$). Since a simple unipotential lens is formed between the first and third electrodes G3 and G5, an electron beam being emitted from cathode K and passing through the pre-focusing lens between screen electrode G2 and first focusing electrode G3, is focused and accelerated by the simple unipotential lens. Then, the electron beam passes through the third focusing lens G5 and anode electrode G6, where it is finally focused and accelerated. Therefore, an electron beam is pre-focused and pre-accelerated at the pre-focusing lens and auxiliary lens, and then finally focused and accelerated at the main lens so that the electron beam has a normal circular cross section which forms a circular beam spot at the center of the screen.

When an electron beam is deflected to the periphery of the screen by the nonuniform magnetic field of the deflection yoke, since the first dynamic focusing voltages of the first and third auxiliary electrodes of the second focusing electrode G4 are different from the second dynamic focusing voltage of the second auxiliary electrode, another unipotential lens is formed between the first and third auxiliary electrodes. The unipotential lens diverges an electron beam vertically and weakly focuses an electron beam horizontally, for an electron beam passing holes of the first, second and third auxiliary electrodes. The electron beam becomes more intense as the lens is farther from the center of the screen.

That is, the first dynamic focusing voltage Vd1 is applied to the first, and third auxiliary electrodes G4*a* and G4*c* of the second focusing electrode G4, and the second dynamic focusing voltage Vd2 is applied to the second auxiliary electrode creating a variable potential difference. More specifically, positive dynamic focusing voltage Vd1 is applied to the first and third auxiliary electrodes G4*a* and G4*c*, and negative dynamic focusing voltage Vd2 is applied to the second auxiliary electrode G4*b*. Thus, a composite unipotential auxiliary lens is formed between the first and third focusing electrodes G3 and G5. Particularly, an intensive diverging lens radiated diverging an electron beam vertically is formed by the vertically elongated electron beam passing holes in the second auxiliary electrode G4*b*. Thus, an electron beam passing through the lens diverges vertically and is relatively weakly focused horizontally so that its cross section is deformed into a vertically elongated form.

Further, positive first dynamic focusing voltage Vd1 is applied to the first and third auxiliary electrodes G4*a* and G4*c*, negative second focusing voltage Vd2 is applied to the second auxiliary electrode G4*b*. Since horizontally elongated electron beam passing holes Hc and Hc' sharing three separate electron beam passing holes of a corresponding electrode are on the inner side of the first and third auxiliary electrodes G4*a* and G4*c*, that is, on the side facing the second electrode G4*b*, a vertically stronger diverging lens is formed to enlarge the aspect ration of the cross section of the vertically elongated electron beam.

The vertically elongated electron beam passes through a bipotential main lens formed between the third focusing electrode G5 and anode electrode G6, is finally focused and accelerated, and is deflected by a deflection yoke to land in the periphery of the screen. Here, when the vertically elongated electron beam is distorted by the nonuniform magnetic field of the deflection yoke and lands in the periphery of the screen, the electron beam forms a circular beam spot.

As described above in detail, the electron gun of the present invention uses two dynamic focusing voltages in a low voltage driving method which applies low dynamic focusing voltages, thereby greatly reducing the possibility of an are discharge between electrodes. Further, the present invention is advantageous in compensating for astigmatism of the electron beam due to the nonuniform magnetic field of the deflection yoke, which realizes sharp picture quality by improving the focusing characteristics of the electron beam.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. In a cathode ray tube having an electron gun for generating multiple electron beams and a deflection yoke for deflecting the electron beams in response to vertical and horizontal deflection signals applied to the yoke, an electron gun comprising a cathode, a control electrode, and a screen electrode as a first triode, at least first, second, and third focusing electrodes as a main lens system, and an anode electrode, wherein the second focusing electrode includes first, second, and third auxiliary electrodes, applying: (i) a first dynamic voltage to said first and third auxiliary electrodes, the first dynamic voltage being synchronous with vertical and horizontal deflection signals applied to the deflection yoke; (ii) a second dynamic voltage to said second auxiliary electrode, the second dynamic voltage being synchronous with the vertical and horizontal deflection signals applied to the deflection yoke; and (iii) a static focusing voltage to said first and third focusing electrodes, the static focusing voltage being higher than the first and second dynamic voltages.

2. The invention as claimed in claim 1, wherein the electron beam passing holes of said second auxiliary electrode are vertically elongated.

3. The invention as claimed in claim 2, wherein the electron beam passing holes of said second auxiliary electrode include vertical extensions.

4. The invention as claimed in claim 1, wherein said first auxiliary electrode includes a horizontally elongated common electron beam passing hole encompassing three separate electron beam passing holes, the common hole being diposed closer to said second auxiliary electrode than the three beam passing holes.

5. The invention as claimed in claim 4, wherein a recess forms the common electron beam passing hole.

6. The invention as claimed in claim 4, wherein said first auxiliary electrode includes a first member including the horizontally elongated common electron beam passing hole and a second member including the three separate electron beam passing holes.

* * * * *